US005998341A

United States Patent [19]

Bhandary et al.

[11] Patent Number: 5,998,341

[45] Date of Patent: Dec. 7, 1999

[54] BAR COMPOSITION COMPRISING WATER-SOLUBLE ANIONIC POLYMER AND/OR COPOLYMER

[75] Inventors: Milind Vinayak Bhandary; Dhanraj Kalyansundaram Chokappa; Velayudhan Nair Kumar; Devadatta Shivaji Sankholkar, all of Mumbai, India

[73] Assignee: Lever Brothers Company, New York, N.Y.

[21] Appl. No.: 08/786,355

[22] Filed: Jan. 16, 1997

[30] Foreign Application Priority Data

Jan. 19, 1996 [IN] India ..... 38/BOM/96
Mar. 4, 1996 [GB] United Kingdom ..... 9604585

[51] Int. Cl.[6] ..... C11D 9/26

[52] U.S. Cl. ..... 510/155; 510/152; 510/156; 510/450

[58] Field of Search ..... 510/124, 125, 510/130, 136, 137, 138, 404, 424, 427, 155, 156, 152, 450

[56] References Cited

U.S. PATENT DOCUMENTS 4,891,149 1/1990 Nagarajan et al. ..... 252/110
5,279,756 1/1994 Savio et al. .
5,409,640 4/1995 Giret et al. ..... 252/546
5,494,533 2/1996 Woodin, Jr. et al. ..... 134/40
5,703,026 12/1997 Setser et al. ..... 510/152
5,776,872 7/1998 Giret et al. ..... 510/124

FOREIGN PATENT DOCUMENTS

89/05598 5/1990 Poland .
2230022 10/1990 United Kingdom .

*Primary Examiner*—Necholus Ogden
*Attorney, Agent, or Firm*—Ronald A. Koatz

[57] ABSTRACT

A composition for personal or fabric washing comprises:

(i) 25 to 70% by weight of surfactant active;

(ii) 0.05 to 5% by weight of water soluble anionic polymer and/or copolymer having a molecular weight of from 500 to 30,000;

(iii) 15 to 50% by weight of water; and (iv) other additives making up the total balance.

Such a composition is particularly suited for producing bars with high water content whilst retaining structural properties and processability. Enhanced physical properties such as higher yield stress, lathering and lower mush are also attained.

8 Claims, No Drawings

BAR COMPOSITION COMPRISING WATER-SOLUBLE ANIONIC POLYMER AND/OR COPOLYMER

This invention relates to compositions of washing bars for personal or fabric washing. The invention particularly relates to compositions with higher water content but retaining the mechanical, structural aspects for satisfactory processability and end user properties such as better feel, lathering, lower sog/mush and satisfactory cleaning.

BACKGROUND AND PRIOR ART

Conventional detergent bars based on soap for personal washing contains over about 70% by weight total fatty matter (TFM), the remainder being water (about 10–20%) and other ingredients e.g. colour, perfume, preservatives etc. Many particulate materials may also be present which replace some of the soap in the bar while retaining satisfactory processability.

Yield stress needed to cause a flow in a material is of fundamental importance in determining the structural stability and integrity of multiphase composites such as soaps and detergents. Yield stress plays a major role in the processability of soaps and detergents especially in soap processing equipment such as roll mills, plodders, stampers etc.

Milled bars typically have a water content of between 8–15% while 'hard' (non-milled) soap bars have water content in the region of 20–35%. Increase in the water content can replace the TFM making it more economical but will tend to soften the soap bar.

GB 2,230,022 discloses the use of polyacrylate and citrate as barrier materials to improve the softening of the washed fabric by clay in detergent powder formulations. U.S. Pat. No. 5,279,756 discloses the use of acrylic polymers and carboxylic acids as sequestering agents in dish washing compositions. ER 8905598 discloses the use of two specific polymers namely acrylic polymer CO-1 (Acrysol LMW-400N), Rohm and Haas, and Acrysol ASE-75 of Rohm and Haas with a molecular weight of 40,000 to make the bar harder, improve foaming and skin feel. It further specifies that 'high molecular weight acrylic polymers are used because the higher viscosity of the liquid will make more distinct striations and, since the acrylic polymer is on the surface, provides better lubricity to hands during washing with the detergent bar'. The compositions disclosed in this patent are of fairly low water concentrations where hardening is not a problem.

The present invention differs from the prior art in that it addresses the problem of producing bars with high water content which normally would be soft and pose acute problems in processing and unsatisfactory end use.

It is the basic objective of the present invention to provide for washing compositions with higher water content but retaining the appropriate structural properties and processability. The composition would also have enhanced physical properties such as higher yield stress, lathering, better feel, lower sog/mush and satisfactory cleaning.

DEFINITION OF THE INVENTION

Thus the present invention is directed to improved washing formulations with higher water content but retaining superior physical properties such as mechanical, structural aspects for satisfactory processability and end user properties such as better feel, lathering, lower sog/mush and satisfactory cleaning, by way of incorporation of a synergistic additives comprising of water soluble anionic polymers and/or copolymers, having a molecular weight range 500–30,000, in the range of 0.05 to 5% by weight of the formulation and may optionally comprise of one or more of carboxylated compounds at concentrations up to 5% by weight of the total formulation

DESCRIPTION OF THE INVENTION

According to this invention, there is provided a washing composition with higher water content but retaining excellent: yield stress, improved lathering, feel and satisfactory cleaning comprising:

(i) 25 to 70% by weight of soap/detergent actives (ii) 0.05 to 5% by weight of water soluble anionic polymers and/or copolymers, having a molecular weight range 500–30,000, (iii) optionally up to 5% of carboxylated compounds (iv) 15 to 50% by weight of water and balance being other additives.

The actives in the composition is provided by neat soap obtained from saponification of oils/fats such as rice bran, tallow, palm, castor, groundnut, palm kernel, cotton seed, soybean, coconut etc. or their respective fatty acids and/or any of the synthetic detergents.

The water soluble anionic polymers that can be used in the formulations according to the invention include polyacrylic acid, polymethacrylic acid, polystyrene sulphonic acid, acrylic acid-maleic acid copolymers etc. Suitable water soluble copolymers include combination of monomers, at least one of which contains hydrophilic groups like sulphonic acid, sulphate or carboxylic acid or their salts, e.g. acyrlamide-acrylic/methacrylic acid copolymers, polyacrylamide maleic acid copolymers, acrylic/methacrylic acid copolymers.

The above water soluble anionic polymers and water soluble co-polymers is selected to have a molecular weight range 500–30,000. The preferred water soluble anionic polymer is polyacrylic acid in the molecular weight range 500–5000.

The carboxylated compounds preferably are citric acid, lactic acid and maleic acid.

It is found by way of this invention that a synergistic effect is achieved in as far as increasing the water content of the soap formulations while retaining the physical properties of the soap in use of the above synergistic additives in soap formulations in the selected range as proposed above.

The nature of invention, its object and advantages will be further apparent form the ensuing description made with relation to non-limiting exemplary control formulation without the synergistic additive discussed above and formulations according to the invention including such synergistic additives.

EXAMPLES

EXAMPLE 1

Sodium oleate soap containing 30% moisture (Control) and the soap containing polyacrylic acid of different molecular weights were prepared and yield stress (Carri-Med Rheometer) was measured.

Yield Stress Measurement

The Carri-Med Rheometer being a controlled stress rheometer can be used to measure the yield stress of materials under shear conditions. The controlled stress rheometer can apply stresses as low as 0.07 Pa and the stress value at which flow is initiated is a direct measure of the yield stress of the material (strain rate is measured). Carri-Med rheometer model CSL100 was used with a cone and plate fixture having a 2 cm diameter and an angle of 1°58'. The measurements were carried out at 40° C. The maximum yield stress that can be measured on this instrument is 6300 pa. and the minium detectable strain rate is about $10^{-6}$ $sec^{-1}$.

Date presented in Table 1 shows effect of molecular weight of PAA on yield stress.

TABLE 1

| Ingredients in formulation | Yield Stress, Pa. |
|---|---|
| Sodium oleate (Active) | 784 |
| Active + 5% PAA (MW) 90,000 | 550 |
| Active + 5% PAA (MW) 5000 | 932 |
| Active + 5% PAA (MW) 2000 | 1880 |

MW = Molecular weight.

The data presented in Table 1 shows that lower molecular weight PAA are better in improving the yield stress of the soap.

EXAMPLE 2

EXAMPLE a

Control Formulation

The soap base (300 g) containing 30% coconut oil fatty acid salt, balance being the salts of distilled fatty acids derived from a mixture of oils (e.g. rice bran/palm) of moisture content 10.8% was taken in an autoclave and heated to 50° C. 83 ml of water was added to it and the soap was stirred and heated to 95° C. for 3hrs. The soap melt was fed slowly into another chamber below the autoclave which was maintained under vacuum. The vacuum dried soap (moisture 27%) was cooled to 25–30° C., passed through a triple roll mill and plodded into bars.

The milled soap mentioned above were dried in an air oven (40–45° C.) before plodding for making soaps with lower moisture contents.

EXAMPLE b

Experimental Formulation

The soap base (300 g) was prepared as in the case of control but a mixture containing 1 g. sodium hydroxide, 1.5 g. polyacrylic acid (PAA) (SOKOLAN PA ex. BASF, mol.wt.1500) and 1.5 g. citric acid dissolved in 83 ml of water was added to the soap in the autoclave. The soap was stirred and heated to 95° C. for 3hrs. The soap melt was fed slowly into another chamber below the autoclave maintained under vacuum. The vacuum dried soap was cooled to 25–30° C., passed through a triple roll mill and plodded into bars.

The milled soap mentioned above were dried in an air oven (40–45° C.) before plodding for making soaps with lower moisture contents.

The samples as per Example a and b were subjected to yield stress and penetration tests following the method described herein.

Yield Stress Measurement

The apparatus consists of a cheesewire attached to a counter balanced arm which can pivot freely via a ball race bearing. A billet of soap is positioned under the wire such that the wire is just in contact with one edge of the billet. By applying a weight (W g.) directly above the cheesewire a constant force is exerted on the wire which will slice into the soap. The area over which the force acts will increase as the depth of cut increases and therefore the stress being exerted will decrease until it is exactly balanced by resistance of the soap and the wire stops moving. The stress at this point is equal to the yield stress of the soap. The time taken to reach this point was found to be 30 secs. so that a standard time of 1 min was chosen to ensure that the yield stress had been reached. After this time the weight was removed and the length of the cut measured.

The yield stress is calculated using the semi-empirical formula:

$$Y.S = \frac{3W \times 98.1}{81 \times d} \text{ Pascal (Pa.)}$$

The Penetration Test

A pointed metal cone of specified dimensions is allowed to penetrate into the bar using standard weight on the top of the cone. The cone penetrates the bar up to a certain depth till the downward force due to weight balances with the upward force due to the drag. The depth is measured in units of 1/10 of a mm. Higher penetration means lower yield stress.

TABLE 2

| % Moisture | Example a YS* × $10^5$ | Penetration value | Example b YS* × $10^5$ | Penetration value |
|---|---|---|---|---|
| 27 | 1.8 | 45 | 3.7 | 33 |
| 22 | 4.2 | 31 | 7.4 | 22 |
| 17 | 7.3 | 15 | 9.8 | 17 |

*YS = Yield stress in Pa.

The data presented in Table 2 clearly show that soaps containing the synergistic additive of the invention (Example b) has a significantly higher yield stress indicating that the presence of the additive results in soap bars which are processable by the milled route in spite of higher moisture content.

EXAMPLE 3

Soap (Sodium oleate) formulations as indicated in Table 3 were prepared and the data on yield stress was measured as per the procedure described as in Example 1.

| Ingredients (%) | Example c | Example d | Example e | Example f |
|---|---|---|---|---|
| Soap | 73 | 72 | 72 | 72 |
| PAA | — | 1 | — | 0.5 |
| Citric acid | — | — | 1 | 0.5 |
| Water | 27 | 27 | 27 | 27 |
| Yield stress P.a | 573 | 1389 | 1018 | >6360 |

The data on yield stress presented in Table 3 shows that even when Polyacrylic acid (PAA) and citric acid are added at 0.5% each in the formulation they give a synergistic effect and show that the yield stress is enhanced far greater than when PAA or citric acid is used alone at 1% level.

EXAMPLE 4

Control and experimental bars as per the formulation described in Table 4 were prepared and data on yield stress (measured as described in Example 2), rate of wear, lather, mush and feel were recorded. The soap comprised of 30% coconut oil fatty acid salt, balance being the salts of distilled fatty acid derived from a mixture of oils (eg. rice bran/palm). The soap contained 30% water to which various ingredients (PAA, citric acid, perfume etc.) were added and the mixture dried to the final moisture content indicated in Table 4.

Rate of Wear

A set of bars is used to wash in a standard manner once daily by each operator and drained after each wash, for five days. After two further non-washing days, % wear is determined as weight loss. This is a standardised simulation of use.

Lather

The test involves a panel of volunteers who wash their hands with the test tablets once during the test. The hand wash is performed 24° French hard (FH) water in a bowl and volume of lather produced is measured.

Feel

A standard washing procedure in cold water followed by estimation of feel by a trained observer.

Mush

A set of bars is used to wash in a standard manner once daily by each operator for five days. From the second day onwards, the depth of the mush on the bar is evaluated by trained assessor using a calibrated scale in mm. The values over 5 days are monitored and the final day value is reported. This is a standardised simulation of use.

TABLE 4

| Ingredients (%) | Control | Experimental |
|---|---|---|
| Soap | 84.2 | 79.9 |
| PAA | 0 | 0.5 |
| Citric acid | 0 | 0.5 |
| Moisture | 14.0 | 17.3 |
| Perfume etc. | 1.8 | 1.8 |
| Water/soap | 0.17 | 0.22 |
| Yield stress ($10^6$ Pa) | 2.8 | 3.3 |
| % Rate of wear | 39.6 | 42.4 |
| Lather (24° FH) | 174.0 | 186.0 |
| Mush | 5.7 | 4.0 |
| Feel | Satisfactory | Superior |

The data presented in Table 4 shows that the experimental bar has significantly higher yield stress and other in use properties.

Thus the present invention is directed provide for improved soap/detergent formulations having higher water content but retaining the mechanical, structural aspects for satisfactory processability and end user properties such as better feel, lathering, lower sog/mush and satisfactory cleaning.

We claim:

1. A bar composition for personal or fabric washing comprising:

(i) 25 to 70% by weight of surfactant active;

(ii) 0.05 to 5% by weight of water soluble anionic polymer and/or copolymer having a molecular weight of from 500 to 5,000;

(iii) 0.5 to 5% by weight of citric acid, (iv) 15 to 50% by weight of water; and (v) other additives making up the total balance.

2. A composition as claimed in either claim 1 wherein the surfactant active is selected from the group consisting of (i) a synthetic detergent;

(ii) a neat soap obtainable from saponification of oils or fats; or (iii) mixtures thereof.

3. A composition as claimed in claim 2, wherein the oils or fats are rice bran, tallow, palm castor, groundnut, palm kernel, cotton seed, soybean or coconut.

4. A composition as claimed in claim 1 wherein the water soluble anionic polymer is polyacrylic acid, polymethacrylic acid, polystyrene sulphonic acid or acrylic acid/maleic acid copolymer.

5. A composition as claimed in claim 1 wherein the water soluble anionic polymer is a combination of monomers at least one of which contains a hydrophilic group.

6. A composition as claimed in claim 5, wherein the water soluble polymer is acrylamide-acrylic/methacrylic acid copolymer, polyacrylamide maleic acid copolymer or acrylic/methacrylic acid copolymer.

7. A composition as claimed in claim 1, wherein the water soluble polymer is polyacrylic acid of molecular weight from 500 to 5000.

8. A composition according to claim 5, wherein said hydrophilic group is selected from the group consisting of sulfonic acid, sulfuric acid, carboxylic acid, salts of said acids and mixtures thereof.

* * * * *